United States Patent [19]

Steinberg et al.

[11] Patent Number: 4,566,013

[45] Date of Patent: Jan. 21, 1986

[54] COUPLED AMPLIFIER MODULE FEED NETWORKS FOR PHASED ARRAY ANTENNAS

[75] Inventors: Richard Steinberg, Columbia, Md.; J. Paul Shelton, Arlington, Va.

[73] Assignee: The United States of America as represented by the Secretary of the Navy, Washington, D.C.

[21] Appl. No.: 481,432

[22] Filed: Apr. 1, 1983

[51] Int. Cl.[4] ..... H01Q 3/26

[52] U.S. Cl. ..... 343/372

[58] Field of Search ..... 343/368, 369, 371, 372, 343/373

[56] References Cited

U.S. PATENT DOCUMENTS

| | | | |
|---|---|---|---|
| 3,710,329 | 1/1973 | Mailloux et al. | 343/100 |
| 4,017,867 | 4/1977 | Claus | 343/854 |
| 4,041,501 | 8/1977 | Frazita et al. | 343/373 |
| 4,051,474 | 9/1977 | Mack et al. | 343/100 |
| 4,129,873 | 12/1978 | Kennedy | 343/854 |
| 4,213,133 | 7/1980 | Hidaka | 343/854 |
| 4,277,787 | 7/1981 | King | 343/100 |
| 4,280,128 | 7/1981 | Masak | 343/100 |
| 4,283,729 | 8/1981 | Richardson | 343/380 |

*Primary Examiner*—Eli Lieberman

*Attorney, Agent, or Firm*—Robert F. Beers; William T. Ellis; John L. Forrest

[57] ABSTRACT

A beam-steering feed network for use with linear and planar phased-array antenna systems which includes a phase divider system for producing a plurality of incrementally phased IF signals. The phase divider system includes a plurality of coupled amplifier phase divider modules coupled together to form a network. The network is coupled to receive at least two boundary signals having different phase angles. The phase angle difference between the boundary signals is divided by the phase divider modules in the network. Each module produces an output signal having a phase angle differing from that of the output signals of the immediately adjacent modules in the network by a phase angle gradient. The system thus divides the phase angle difference between the boundary signals into a plurality of incrementally phased output signals.

24 Claims, 11 Drawing Figures

COUPLED AMPLIFIER MODULE FEED NETWORKS FOR PHASED ARRAY ANTENNAS

BACKGROUND OF THE INVENTION

The present invention relates, in general, to a novel beam-steering feed network for use with linear and planar phased-array antenna systems and more particularly to a novel phase divider system for use in a beam-steering feed network.

The high cost of phased array antennas prevents their utilization in many applications where electronic scanning could provide large performance improvements relative to mechanically scanned antennas. One reason for the high cost of conventional phased arrays is their parallel construction: each radiating element has its own phase control. Previously proposed approaches to reducing system cost by even modest reductions in the number of phase shifter elements result in objectionable increases in sidelobe levels.

The present invention provides a novel phased array beam steering feed network which solves this problem by greatly reducing the number of phase shifting elements thereby greatly reducing the cost of phased array antennas.

SUMMARY OF THE INVENTION

Accordingly, one object of the present invention is to provide a novel phase divider system for use in a novel beam-steering feed network useable with linear and planar phased-array antenna systems.

Another object is to significantly reduce the number of phase shift elements needed to feed phased-array antenna systems.

Still another object is to reduce the cost of feed networks used in phased-array antenna systems.

These and other objects and advantages are achieved in a novel phase divider system according to the present invention which produces a plurality of incrementally phased output signals. The phase divider system includes a plurality of coupled amplifier phase divider modules coupled together to form a network. The network is coupled to receive at least two boundary signals having different phase angles. The phase angle difference between the boundary signals is divided by the phase divider modules in the network. Each module then produces an output signal having a phase angle differing from that of the output signals of immediately adjacent modules in the network by a phase signal gradient. The system thus divides the phase angle difference between the boundary signals into a plurality of incrementally phased output signals.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
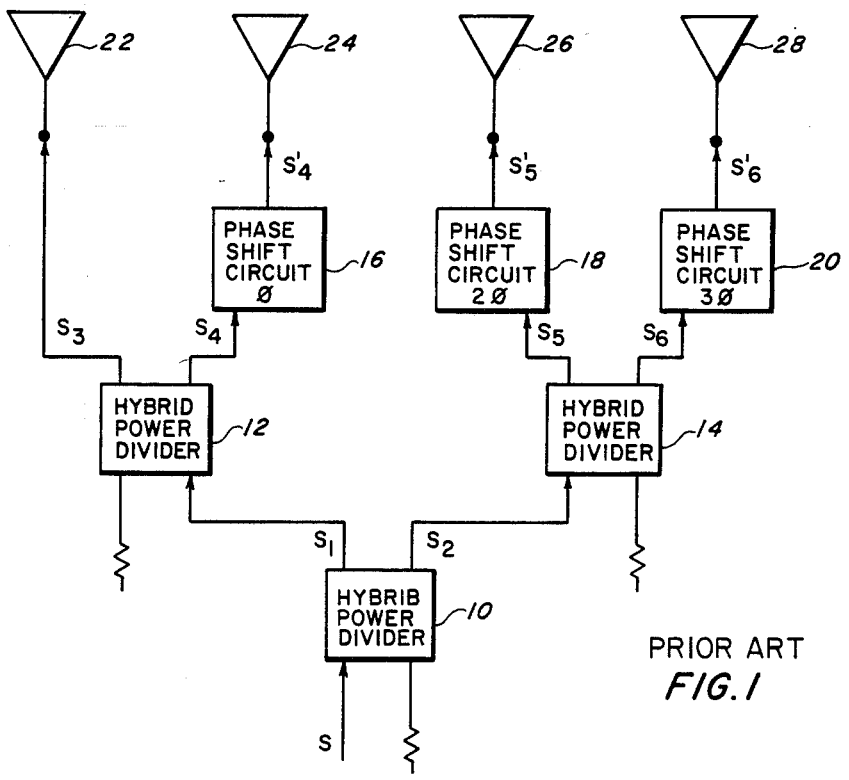
PRIOR ART FIG. 1
FIG. 1 is a schematic diagram illustrating a prior art linear array corporate feed system.

Referring now to the drawings, wherein like reference characters designate identical or corresponding parts throughout the several views, and more particularly to FIG. 1 thereof, a typical prior art linear array corporate feed system is depicted in the form of a four element linear array. In this array in the transmit mode an input signal S is divided into two signals $S_1$ and $S_2$ by a hybrid power divider 10. The signal $S_1$ is further divided into two signals $S_3$ and $S_4$ by a hybrid power divider 12 while the signal $S_2$ is divided into two signals $S_5$ and $S_6$ by a hybrid power divider 14. The signals $S_4$, $S_5$, and $S_6$ are shifted in phase to form signals $S_4'$, $S_5'$, and $S_6'$, respectively, by means of phase shift circuits 16, 18, and 20, respectively. The signal $S_3$ and the phase shifted signals $S_4'$, $S_5'$, and $S_6'$ are fed to four respective antennas 22, 24, 26 and 28. In the receive mode, the circuit functions remain the same but the signals travel in opposite directions from the antennas back to the hybrid 10.

As can easily be seen from FIG. 1, the prior art linear array corporate feed system requires one phase shift circuit for each antenna element. To generalize for this system, an N-element linear array requires a conventional corporate feed with (N−1) phase shift circuits and an N X M-element rectangular array requires a conventional feed with (NM−1) phase shift circuits.

Figure 2:
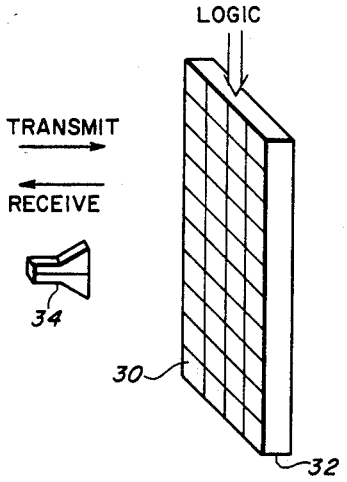
PRIOR ART FIG. 2
FIG. 2 is a schematic diagram illustrating a prior art space-fed phased array system.
Figure 3:
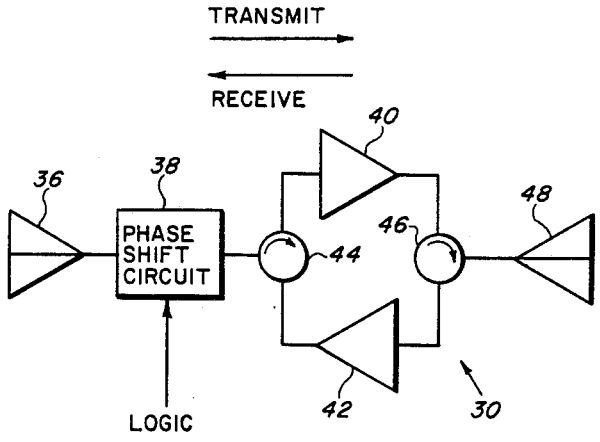
PRIOR ART FIG. 3
FIG. 3 is a schematic diagram illustrating a prior art phase shift module used in the phased array system shown in FIG. 2.

FIGS. 2 and 3 illustrate a typical prior art space-fed phased array system. In FIG. 2, a plurality (N X M) of phase shift modules 30 are arranged in an N X M element array 32 spaced a given distance from an RF feed horn 34. In the transmit mode, RF excitation from the feed horn 34 illuminates each of the modules 30 in the array 32. Each module 30 phase shifts, amplifies, and radiates the received excitation signal. The combined outputs of the modules 30 form the desired transmitted beam pattern. The reverse process is performed in the receive mode.

FIG. 3 illustrates a typical prior art phase shift module 30 as used to form the array 32 in FIG. 2. The module 30 includes a lens radiator 36 for communicating with the feed horn 34, a bi-directional phase shift circuit 38 for altering the phase of transmitted or received signals, a transmit amplifier 40, a receive amplifier 42, two circulators 44 and 46 for controlling the signal flow through the amplifiers 40 and 42, and an aperture radiator 48 for transmitting and receiving signals external to the system.

It should be apparent from FIGS. 2 and 3 that the conventional space-fed phased-array configuration requires one phase shift circuit for each aperture radiator. Thus in FIG. 2, (M X N) phase shift circuits are required.

The present invention provides a novel means for greatly reducing the number of phase shift circuits required to implement the equivalent of the linear corporate feed arrays (FIG. 1) and space-fed arrays (FIGS. 2 and 3).

Figure 4:
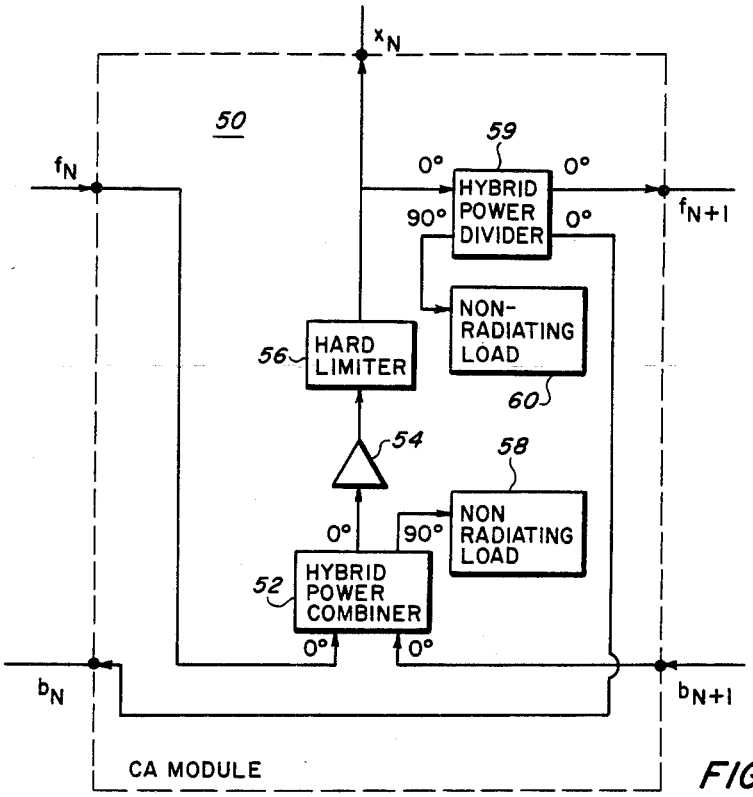
FIG. 4 is a schematic diagram illustrating a coupled amplifier module according to a preferred embodiment of the present invention.

The present invention will now be described in detail with reference to FIGS. 4 through 11. FIG. 4 illustrates a coupled amplifier (CA) module 50 according to a first preferred embodiment of the present invention. In the CA module 50, two module inputs $f_N$ and $b_{N+1}$ are combined in a hybrid power combiner 52. The 0° phase shift output of the hybrid 52 is coupled to a hard-limited IF(or RF) amplifier 56 through an amplifier 54. The hybrid 52 is balanced by coupling its 90° phase shift output to a non-radiating matched load 58 which provides an appropriate impedance match for the hybrid 52. The hard-limited amplifier is a conventional hard-limiter or clipper circuit which provides a constant amplitude output for a wide range of input amplitude variations. The gain of the amplifier 54 is determined such that the hard-limited amplifier 56 operates over the entire input amplitude range contemplated.

The output of the hard-limited amplifier 56 is supplied to the CA module phased output terminal $X_N$. Additionally, the output of the hard-limited amplifier 56 is fed to the input of a hybrid power divider 59. The 0° phase terminals of the hybrid 58 are coupled to two module output terminals, $b_N$ and $f_{N+1}$. The 90° phase terminal of the hybrid 59 is coupled to a non-radiating matching load 60 which provides an appropriate impedance match for the hybrid.

The hybrid power combiner 52 and the hybrid power divider 59 are standard 3 db hybrid circuits. These hybrid circuits may be appropriately configured to combine or divide signals, as is well-known in the art. As a result of the signal division preformed by the hybrid 59, the amplitude of the signal $b_N$ is equal to that of the signal $f_{N+1}$.

The principle of operation of the CA module 50 is based on the simple fact that the phase of the resultant of the vectoral addition of any two equal amplitude signals is equal to the average phase of the equal amplitude signals. The hard-limited amplifier 56 in conjunction with the amplifier 54 forces the amplitudes of the input signals $f_N$ and $b_{N+1}$ to be equal over the effective dynamic range of the hard-limited amplifier 56. The output ($X_N$) of the hard-limited amplifier 56 represents the vectoral sum of these equal amplitude signals and thus the phase of this output signal is the arithmetic average of the phases of the input signals $f_N$ and $b_{N+1}$. The CA module 50 thus operates as a phase divider.

The phases of the signals appearing at the terminals $b_N$ and $f_{N+1}$ are equal to the phase of the module output $X_N$ and thus are equal to the phase average of the signals $f_N$ and $b_{N+1}$. The signal $b_N$ is termed the "feedback" signal while the signal $f_{N+1}$ is termed the "feed-forward" signal. A plurality of CA modules 50 may be serially arranged to form a network which effectively divides the phase difference between two boundary signals into a plurality of incrementally phased output signals as will be illustrated below with respect to FIG. 5.

Figure 5:
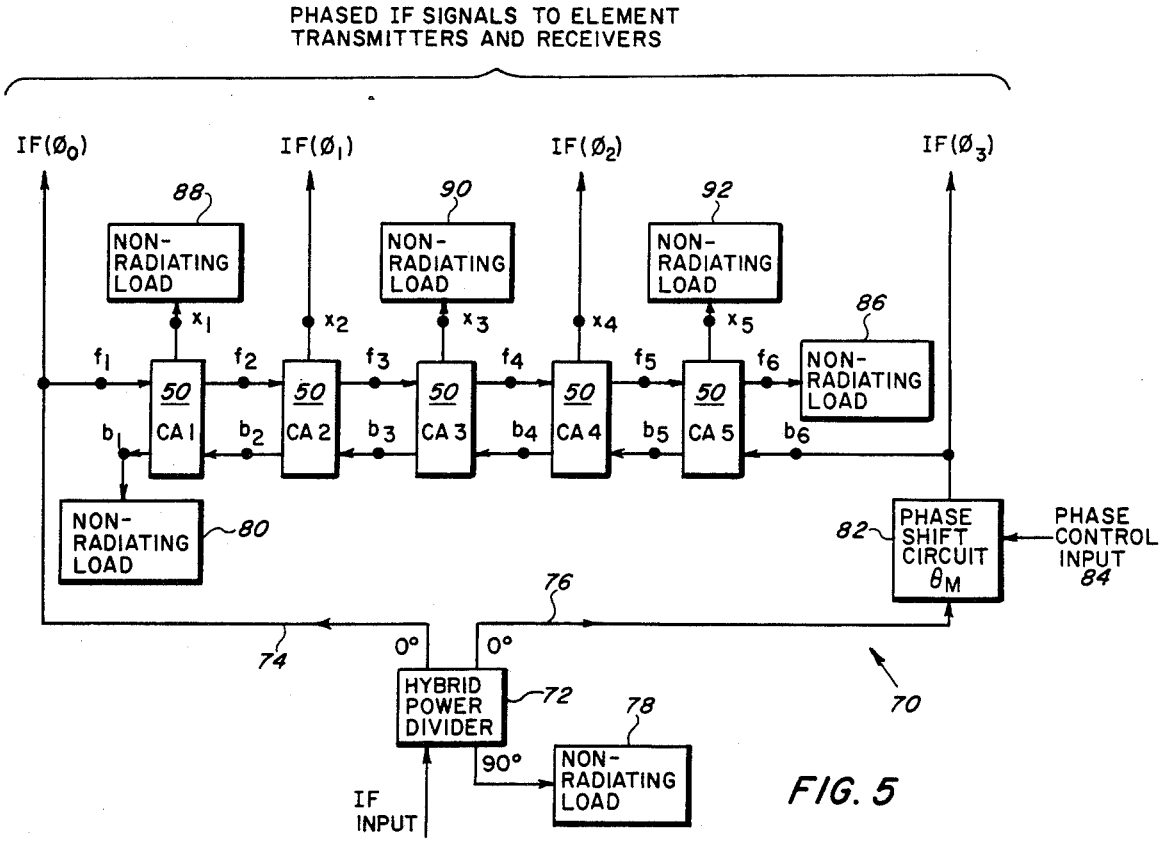
FIG. 5 is a schematic diagram illustrating a phase shift network according to a preferred embodiment of the present invention.

FIG. 5 illustrates a phase shift network 70, according to a preferred embodiment of the present invention, for supplying incrementally phased IF signals to a linear array. In the system of FIG. 5, five CA modules, 50 (as shown in FIG. 4) designated CA 1 through CA 5 are utilized to form four phased IF signals. As shown, the five CA modules 50 are interconnected such that the $f_N$ input of each CA module is supplied from an $f_{N+1}$ output of a previous module and the $b_{N+1}$ input of each module is supplied from a $b_N$ output of the following module. For example, module CA 2 receives an input $f_2$ from CA 1 and an input $b_3$ from CA 3. The module CA 2 supplies an output $b_2$ to CA 1 and an output $f_3$ to CA 3.

An IF input signal is supplied to an input of a hybrid power divider 72. The input IF signal is divided into two equal amplitude signals at 0° phase shift appearing on lines 74 and 76. The hybrid 70 is balanced by coupling its 90° phase output to a non-radiating matching load 78 which provides an appropriate impedance match for the hybrid. The IF signal appearing on line 74 forms the 0° phase shift output of the phase shift network 70 designated as IF($\phi_o$). Additionally, this signal IF($\phi_o$) is coupled to the $f_1$ ($f_N$, where N=1) input of the first module CA 1. The $b_1$ ($b_N$, where N=1) output of the first module CA 1 is coupled to a non-radiating matching load 80 which provides an appropriate impedance match for the module.

The IF signal appearing on line 76 is coupled to a conventional phase shift circuit 82 which changes the phase of the signal by an amount $\theta_M$ as controlled by a phase control input signal 84. The output of the phase shift circuit 82 forms the IF($\phi_3$) output of the phase shift network 70. Additionally, the IF($\phi_3$) signal is supplied to the $b_6$ ($b_{N+1}$, where N=5) input to the fifth module CA 5. The $f_6$ ($f_{N+1}$, where N=5) output of the fifth module CA 5 is coupled to a non-radiating matching load 86 which provides an appropriate impedance match for the module.

Phase shifted IF signals appear at the phased output ($X_N$) terminals $X_1$ through $X_5$ of the modules CA 1 through CA 5, respectively. These phased outputs may be utilized to provide phase shifted IF signals to element transmitters and receivers in a phased array, as will be discussed below.

Each CA module 50 is capable of developing a maximum phase gradient $\Delta\phi$ (from CA module to CA module) of ±90°. For this reason, if the phased outputs ($X_N$) of each CA module are used, the scanning capability of the associated antenna array will be limited. However, if two CA modules are used for each element in the array the maximum phase gradient will be $2\Delta\phi$ or ±180° and thus will allow full hemispheric scanning capability. Thus in FIG. 5, the phased outputs $X_1$, $X_3$, and $X_5$ of the respective modules CA 1, CA 3, and CA 5 are terminated in non-radiating impedance matching loads 88, 90 and 92, respectively. The phased outputs $X_2$ and $X_4$ of the modules CA 2 and CA 4 are then utilized to supply the phased outputs IF($\phi_1$) and IF($\phi_2$), respectively.

Terminating the unused outputs of modules CA 1, CA 3, and CA 5 in non-radiating loads effectively wastes the outputs of these modules. In some circumstances these outputs could conceivably be utilized. For example, they could be utilized to apply phased outputs to a second linear array or even to a common linear array to create a second transmit or receive beam. These second beams would of necessity be angularly spaced from the first or main beam.

Although the phase shift network 70 of FIG. 5 has been shown using five CA modules 50, it should be understood that fewer or more such modules could be included in the network to develop any desired number of phased outputs.

Figure 6:
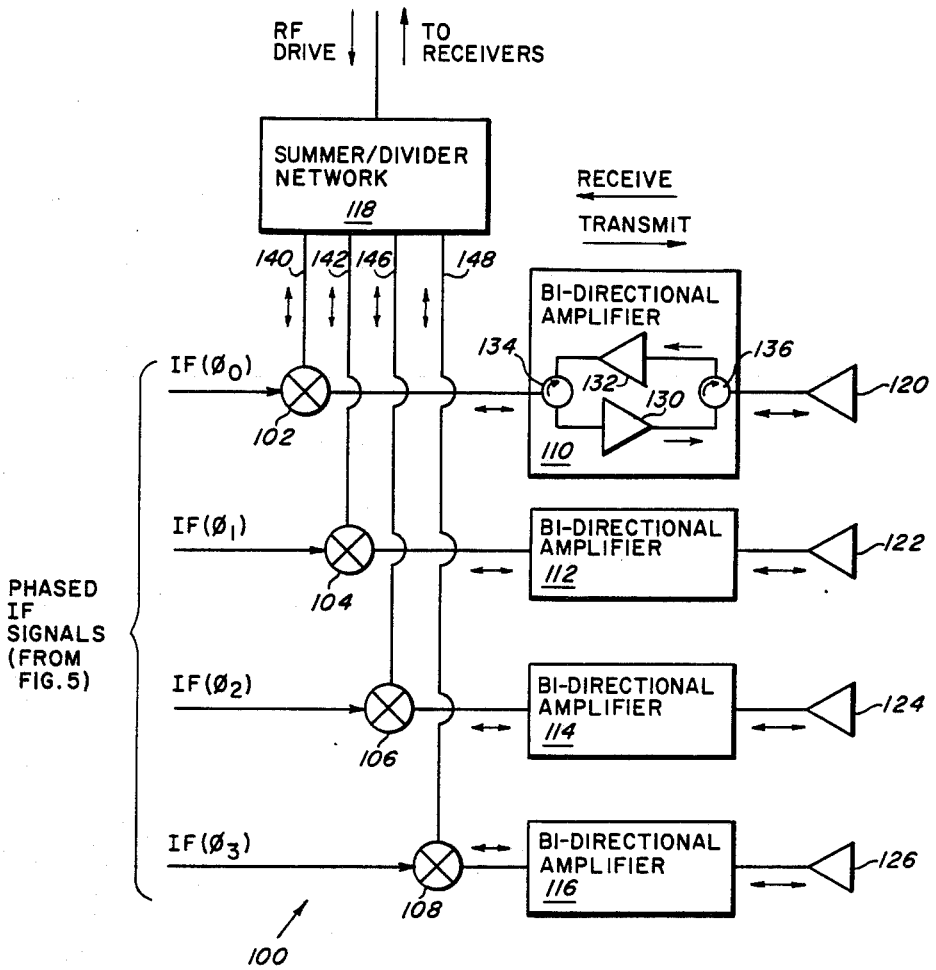
FIG. 6 is a schematic diagram illustrating a linear array according to a preferred embodiment of the present invention which utilizes the outputs of the phase shift network shown in FIG. 5.

FIG. 6 illustrates a four element linear array 100 which utilizes the phased IF outputs of the phase shift network 70 shown in FIG. 5. In the array 100, the phased IF signals IF($\phi_o$) through IF($\phi_3$) are coupled to a plurality of mixer circuits 102, 104, 106 and 108 respectively. The mixer circuits 102 through 108 are each coupled between a plurality of bi-directional amplifier modules 110, 112, 114, and 116, respectively, and a summer/divider network 118. Each of the bi-directional amplifier modules 110 through 116 are respectively coupled to a plurality of antenna elements 120, 123, 124, and 126.

The bi-directional amplifier module 110 includes a transmit amplifier 130 and a receiver amplifier 132 coupled in parallel between two circulators 134 and 136, which control the bi-directional flow of signals between the mixer 102 and the antenna element 120. The remaining bi-directional amplifier modules 112 through 116 are similarly constructed.

The summer/divider network 118 is comprised of a plurality of hybrid networks coupled to operate as a power divider in one direction and to operate as a signal combiner in the other direction, as is well known in the art.

In the transmit mode, the summer/divider network receives an RF drive signal from a source (not shown), divides the RF signal, and outputs the divided RF signals on lines 140, 142, 146 and 148. The divided RF signals are phase shifted by combining them with the phased IF signals IF($\phi_o$) through IF($\phi_3$) in the mixer circuits 102 through 108, respectively. The phase shifted RF signals are then passed through the respective bi-directional amplifers 110 through 116 and supplied to the respective antenna elements 120 through 126. The reverse process takes place in the receive mode. Here amplified received signals are supplied to each of the mixer circuits 102 through 108 by means of the antenna elements 120 through 126 and the bi-directional amplifers 110 through 116. The amplified received signals are phase shifted by combination with the phased IF signals IF($\phi_o$) through IF($\phi_3$) in the mixer circuts 102 through 108, and the phased results are supplied to the summer/divider network 118 via the lines 140 through 148, respectively. These phased received signals are combined in the summer/divider network 118 and the resultant signal is coupled to the receiver system (not shown) for further processing.

The four element linear array 100 of FIG. 6, which utilizes the phased IF signals supplied by the phase shift network 70 of FIG. 5 incorporating the CA modules 50 of FIG. 4, is functionally equivalent to the prior art hybrid corporate feed system shown in FIG. 1. However, the prior art feed system requires three phase shift circuits, whereas the system of the present Invention shown in FIGS. 4 through 6 requires only one phase shift circuit. The number of phase shift circuits required in the prior art feed system increases linearly with the number of antenna elements. For example, a conventional N-element linear array requires a feed network with (N−1) phase shift circuits. By contrast, the number of phase shift circuits required in the system of the present Invention using the CA modules 50 is independent of the array size. Thus, an N-element linear array requires only one phase shift circuit, even for very large values of N.

Returning to FIG. 5, the phase $\theta_N$ of the $X_N$ output of each of the CA modules, CA 1 through CA N, in the phase shift network 70 is given by:

$$\theta_N = N[\Delta\phi - S(2\pi/M)] + \theta_o \text{ for } N = 1, 2, \ldots M \quad (1)$$

where N is the number of each CA module, $\Delta\phi$ is the desired phase gradient to be developed by each CA module, M is the total number of CA modules in the network plus one, $\theta_o$ is the phase of the input IF signal to the network 70, and S is an integer. Further, the actual phase gradient $\Delta\theta_N$ for each CA module is given by:

$$\Delta\theta_N = \Delta\phi - S(2\pi/M) \quad (2)$$

For a network in a steady state condition, the following relationship exists:

$$\theta_{No} = (N)\Delta\theta_N = (N)\Delta\phi_o \quad (3)$$

where $\Delta\phi_o$ is the steady state phase gradient for each CA module. $\Delta\phi_o$ is related to the boundary phase $\theta_M$, set by the phase shift circuit 82, in steady state by:

$$\Delta\phi_o = (\theta_M - \theta_o)/M \quad (4)$$

The inventors have determined that only two values of S will ever occur: S=0 and S=1. Thus, if the network is initially in a steady state condition, a charge in the boundary phase ($\theta_M - \theta_o$) will cause the network to evolve into one of two possible phase distributions depending upon the value of S. The value of S is determined as follows:

$$S = \begin{cases} 0, & (\Delta\phi - \Delta\phi_o) < \Delta_{CRIT} \\ 1, & (\Delta\phi - \Delta\phi_o) > \Delta_{CRIT} \end{cases} \quad (5)$$

$$\text{where: } \Delta_{CRIT} = (\pi - 2\Delta\phi_o)/M \quad (6)$$

For example, if the objective is to increase the phase gradient, $\Delta\phi > \Delta\phi_o$, and we attempt to increase the phase gradient by too large an amount, $(\Delta\phi - \Delta\phi_o) \geqq \Delta_{CRIT}$. From equation 5 we determine that the S=1 phase distribution will be established. Thus $$\theta_N = \theta_o + N(\Delta\phi - 2\pi/M) \quad (7)$$

and $$\Delta\theta_N = \Delta\phi - 2\pi/M \quad (8)$$

Under these circumstances the network "drops" one complete cycle of phasing and the phase gradient is deceased rather than increased.

A more detailed example will now be presented. We assume that the CA network consists of eight CA modules (FIG. 5 contains only five modules), initially phased to 60°/module, i.e., that:

$$M=(\text{No. of modules})+1=9 \quad (9)$$

$$\Delta\phi_o=60° \quad (10)$$

We now consider the effect of attempting to increase the phase gradient to 70°/ module:

$$\Delta\phi=70° \quad (11)$$

The value of the phase shift circuit is originally:

$$\theta_M(\tau=-1)=MOD_{2\pi}(M\Delta\phi_o)=180° \quad (12)$$

and is subsequently increased by 90°:

$$\theta_M(\tau=0)=MOD_{2\pi}(M\Delta\phi)=270° \quad (13)$$

For this example we see that:

$$(\Delta\phi-\Delta\phi_o)>\Delta_{CRIT} \quad (14)$$

since:

$$(\Delta\phi-\Delta\phi_o)=10° \quad (15)$$

while:

$$\Delta_{CRIT}=[180°-2(60°)]/9=6.7° \quad (16)$$

The undesired S=1 phase distribution will then develop, and:

$$\Delta\theta_N=(\Delta\phi-2\pi/M)=30° \quad (17)$$

$$\theta_N=N(30°) \quad (18)$$

The objective was to increase the inter-module phasing from 60°/module to 70°/module. However, as indicated in Equation 17, the effect was a decrease in the phasing from 60°/module to 30°/module.

Table I summarizes the transmit response through the network for the above example. The data in Table I was developed by means of computer simulation of the network. In the Table, time t is presented in normalized form $\tau$ defined as:

$$\tau={}^{t}/T \quad (19)$$

where T is the propagation delay time for each CA module. In general T will be a function of the module configuration and the specific components utilized to form the modules.

TABLE I

| Normalized | CA MODULE PHASE INCREMENTS | | | | | | | | | Phase |
|---|---|---|---|---|---|---|---|---|---|---|
| Time $\tau$ | $\Delta\theta_1$ | $\Delta\theta_2$ | $\Delta\theta_3$ | $\Delta\theta_4$ | $\Delta\theta_5$ | $\Delta\theta_6$ | $\Delta\theta_7$ | $\Delta\theta_8$ | $\theta_9=\theta_M-\theta_8$ | Shifter $\theta_M$ |
| −1 | 60 | 60 | 60 | 60 | 60 | 60 | 60 | 60 | 60 | 180 |
| 0 | 60 | 60 | 60 | 60 | 60 | 60 | 60 | 60 | 150 | 270 |
| 9 | 59 | 55.3 | 55.3 | 41 | 41 | 15.7 | 15.7 | −6.5 | −6.5 | 270 |
| 19 | 48. | 44. | 44. | 33.6 | 33.6 | 26 | 26 | 12.4 | 12.4 | 270 |
| 29 | 39.9 | 37.6 | 37.6 | 36.7 | 36.7 | 25.1 | 25.1 | 20.7 | 20.7 | 270 |
| 49 | 32.9 | 32.2 | 32.2 | 30.5 | 30.5 | 28.6 | 28.6 | 27.3 | 27.3 | 270 |
| 99 | 30.1 | 30.1 | 30.1 | 30. | 30. | 29.9 | 29.9 | 29.9 | 29.9 | 270 |
| 119 | 30. | 30. | 30. | 30. | 30. | 30. | 30. | 30. | 30. | 270 |

It is, in fact, not difficult to increase the phasing of the eight module network described above from 60°/module to 70°/module; however, a multi-step process is required, as described in the next example.

Initially the phasing is increased from 60°/module to 65°/module by imposing the boundary phase:

$$\theta_M(o)=MOD_{2\pi}(M\Delta\phi)=225° \quad (20)$$

Under this condition, $$(\Delta\phi-\Delta\phi_o)=5°<\Delta_{CRIT} \quad (21)$$

where $\Delta_{CRIT}$ was given above in Equation 16. Thus, the S=0 condition will occur and the network will converge to the uniform phase gradient $\Delta\theta_N=65°$/module.

After allowing the network to settle somewhat toward its new steady-state value of 65°/module, a new boundary condition is imposed:

$$\theta_M(o)=MOD_{2\pi}(M\Delta\phi)=MOD_{2\pi}(9\times70°)=270° \quad (22)$$

Here:

$$(\Delta\phi-\Delta\phi_o)_{CRIT}=[180°-2(65°)]=5.56° \quad (23)$$

Thus:

$$(\Delta\phi-\Delta\phi_o)=(78°-65°)=5°<\Delta_{CRIT} \quad (24)$$

Again the S=0 condition will occur and the network will converge to the uniform phase gradient of 70°/module. Thus the two step process allows the network to be "phased up" from 60°/module to 70°/module.

The transient response for the above two step process is presented in Table II, which was developed by means of computer simulation. As shown in Table II, it is not necessary that the network converge to its one-step equilibrium ($\Delta\theta_N=65°$) before initiating step-two. At $\tau=29$, the phase increment varies from $\Delta\theta_1(29)=63.4°$ to $\Delta\theta_9(29)=66.6°$ across the network. It is not necessary for the transient to decay any further. Increasing the boundary phase from $\theta_M(29)=225°$ to $\theta_M(30)=270°$ at $\tau=30$ results in the eventual evaluation of the desired 70°/module phase gradient.

TABLE II

| Normalized | CA MODULE PHASE INCREMENTS | | | | | | | | | Phase |
|---|---|---|---|---|---|---|---|---|---|---|
| Time $\tau$ | $\Delta\theta_1$ | $\Delta\theta_2$ | $\Delta\theta_3$ | $\Delta\theta_4$ | $\Delta\theta_5$ | $\Delta\theta_6$ | $\Delta\theta_7$ | $\Delta\theta_8$ | $\Delta\theta_9=\theta_M-\theta_8$ | Shifter $\theta_M$ |
| −1 | 60 | 60 | 60 | 60 | 60 | 60 | 60 | 60 | 60 | 180 |
| 0 | 60 | 60 | 60 | 60 | 60 | 60 | 60 | 60 | 105 | 225 |

TABLE II-continued

| Normalized Time $\tau$ | CA MODULE PHASE INCREMENTS $\Delta\theta_1$ | $\Delta\theta_2$ | $\Delta\theta_3$ | $\Delta\theta_4$ | $\Delta\theta_5$ | $\Delta\theta_6$ | $\Delta\theta_7$ | $\Delta\theta_8$ | $\Delta\theta_9 = \theta_M - \theta_8$ | Phase Shifter $\theta_M$ |
|---|---|---|---|---|---|---|---|---|---|---|
| 29 | 63.4 | 63.8 | 63.8 | 64.7 | 64.7 | 65.8 | 65.8 | 66.6 | 66.6 | 225 |
| 30 | 63.6 | 63.6 | 64.2 | 64.2 | 65.3 | 65.3 | 66.2 | 66.2 | 111.6 | 270 |
| 49 | 66.5 | 67.3 | 67.3 | 69.3 | 69.3 | 71.7 | 71.7 | 73.4 | 73.4 | 270 |
| 99 | 69.8 | 69.9 | 69.9 | 70. | 70. | 70.1 | 70.1 | 70.2 | 70.2 | 270 |
| 119 | 70. | 70. | 70. | 70. | 70. | 70. | 70. | 70. | 70. | 270 |

Figure 7:
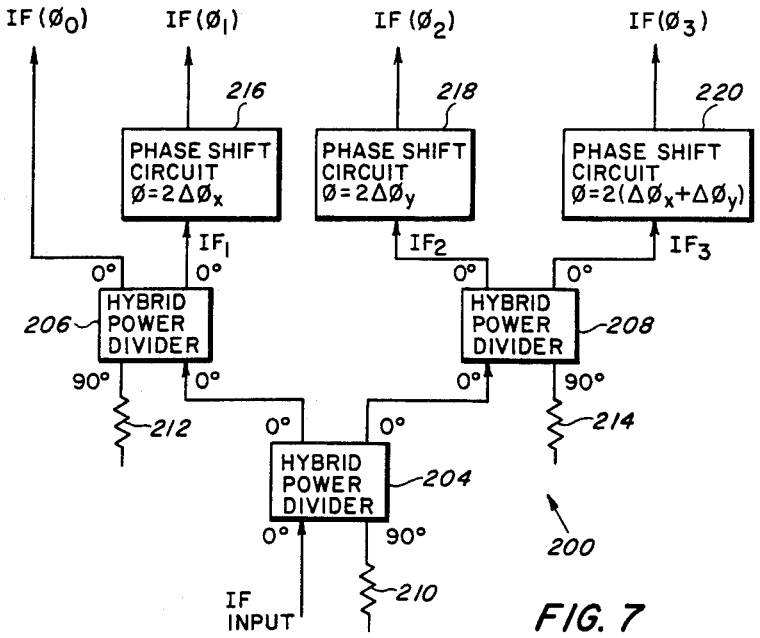
FIG. 7 is a schematic diagram illustrating a boundary phase circuit according to a preferred embodiment of the present invention.
Figure 8:
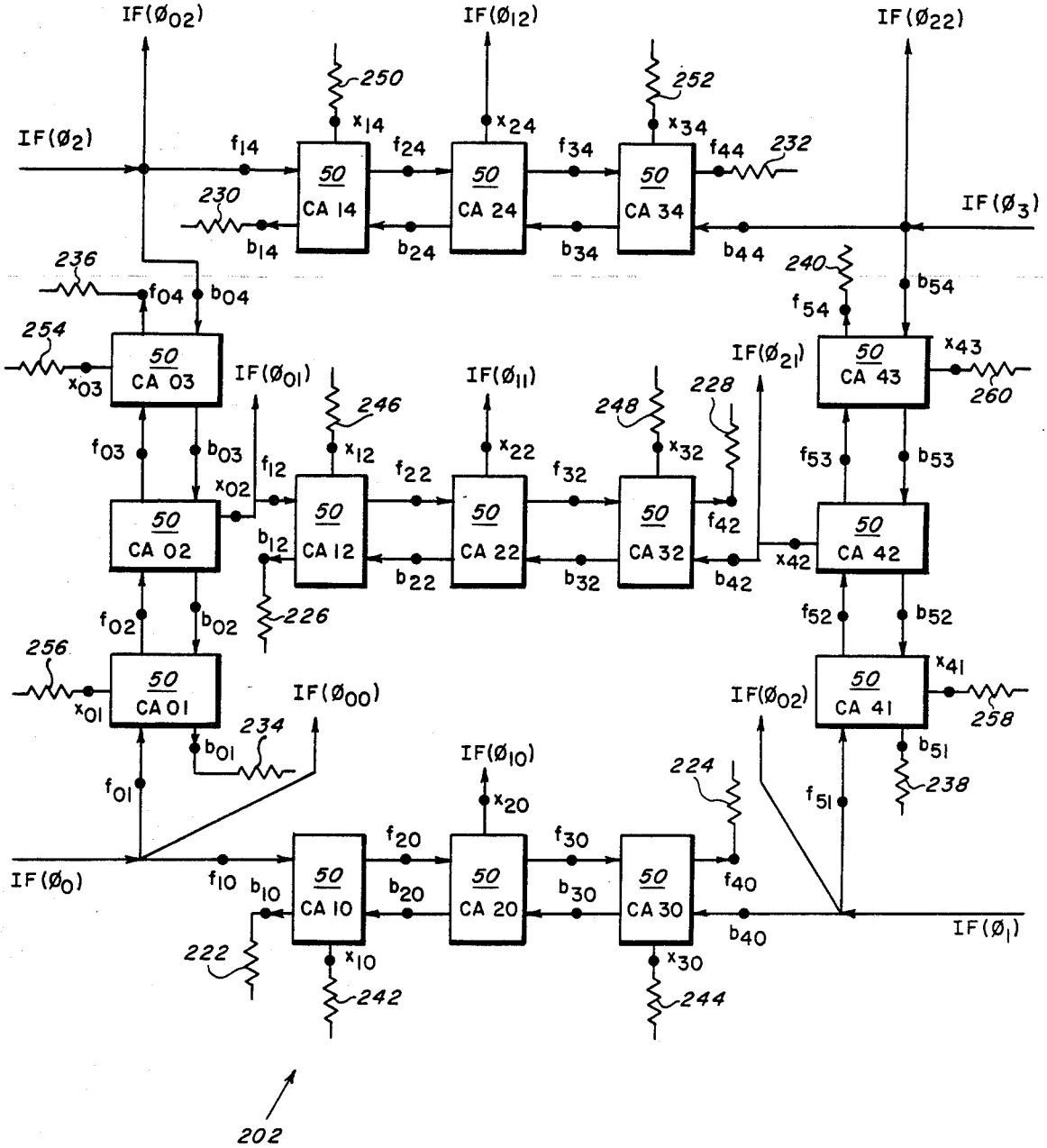
FIG. 8 is a schematic diagram illustrating a phase shift network according to a preferred embodiment of the present invention.

FIG. 7 and 8 illustrate a phase shift network, according to another preferred embodiment of the present Invention, for supplying incrementally phased IF signals to a two-dimensional array. FIG. 7 illustrates a boundary phase circuit 200 while FIG. 8 illustrates the actual phase shift network 202 which utilizes the boundary phase signals developed in FIG. 7.

In FIG. 7 an IF input signal is divided into four equally phased IF signals IF($\phi_o$), IF1, IF2, and IF3 by means of three hybrid power divider circuits 204, 206, and 208. The 90° outputs of the hybrid circuits are loaded with non-radiating matched loads 210, 212, and 214, as shown. Although not illustrated, each load is coupled to ground or an appropriate signal return. The divided signals IF1, IF2, and IF3 are each shifted in phase by phase shift circuits 216, 218, and 220, respectively. The boundary phase circuit 200 thus produces four equal amplitude phased IF signals IF($\phi_o$), IF($\phi_2$), and IF($\phi_3$).

The phase shift network 202 shown in FIG. 8 includes a plurality of CA modules 50 (as shown in FIG. 4 and as described above) arranged in rows and columns to form a matrix with boundary phase values applied at the four corners. Each row and column of the matrix is comprised of three CA modules connected together in the manner shown in FIG. 5. Thus the row including CA modules CA10, CA20, and CA30 receives IF signal IF($\phi_o$) as its lower boundary value and the signal IF($\phi_1$) as its upper boundary value. Similarly the column including CA modules CA01, CA02, and CA03 receives the signal IF($\phi_o$) as its lower boundary and the signal IF($\phi_2$) as its upper boundary. The remaining outer row and column are similarly arranged to receive the boundary signals IF($\phi_1$), IF($\phi_2$), and IF($\phi_3$), as shown. The boundary signals IF($\phi_o$) through IF($\phi_3$) as supplied by the boundary phase circuit shown in FIG. 7.

The middle row including CA modules CA12, CA22, and CA32, however, does not receive an external boundary phase signal. This row utilizes the $X_{02}$ output of the module CA02 as its lower boundary and the $X_{12}$ output of the module CA42 as its upper boundary value. Thus the boundary values for this row are generated within the network thereby eliminating the need for additional phase shift circuits.

The feedback signals ($b_N$) of the lower end CA module in each row and one end module in each column are coupled to non-radiating loads. Similarly the feedforward signals ($f_{N+1}$) of the upper end CA module in each row and the opposite end module in each column are coupled to non-radiating loads. These loads are designated by reference numerals 222 through 240. The loads are all coupled to ground or to an appropriate signal return.

The outputs of the phase network 202 are comprised of the four boundary value signals and the phased output ($X_N$) of the middle CA module in each row and column. The network thus produces nine phased IF signal outputs IF($\phi_{oo}$) through IF($\phi_{22}$). The phased outputs ($X_N$) of the remaining CA modules are terminated in non-radiating loads which are designated by reference numerals 242 through 260. The loads are all coupled to ground or to an appropriate signal return. As described above with respect to FIG. 5, the use of every other phased output ($X_N$) allows the network to generate a maximum phase gradient of ±180°. If every output is used, the phase gradient is limited to ±90°.

As previously described with respect to FIG. 5, the unused module outputs could also be utilized to supply phased signals for other uses within the same or different systems and thus need not be wasted in load impedance. Also, it should be understood that fewer or more modules can be included in the phase shift network in order to provide any desired number of phased output signals.

Figure 9:
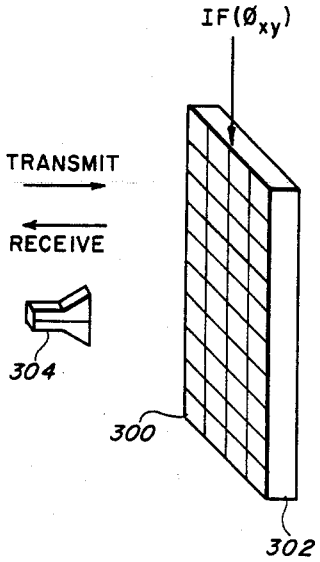
FIG. 9 is a schematic diagram illustrating a space-fed phased array system according to a preferred embodiment of the present invention which utilizes the outputs of the phase shift network shown in FIG. 8.
Figure 10:
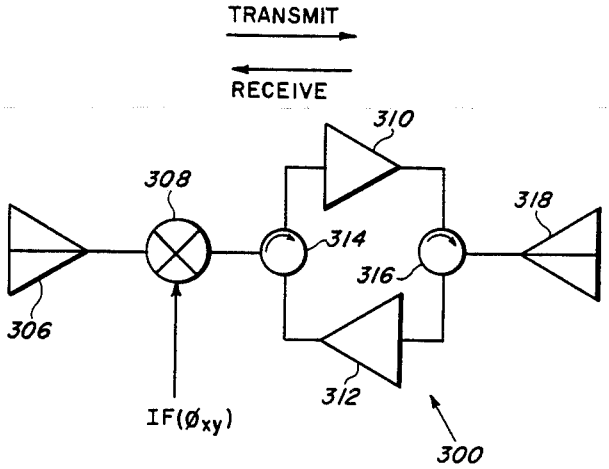
FIG. 10 is a schematic diagram illustrating a bidirectional amplifier module according to a preferred embodiment of the present invention which is used in the phased array shown in FIG. 9.

FIGS. 9 and 10 illustrate a space-fed phased array system according to the present invention utilizing the phase shift network shown in FIGS. 7 and 8. In FIG. 9 a plurality (N X M) of phase shift amplifier modules 300 are arranged in an N x M element array 302 spaced a given distance from an RF feed horn 304, in a form similar to that shown in FIG. 2. In the transmit mode, RF excitation from the feed horn 304 illuminates each of the modules 300 in the array 302. Each module 300 phase shifts, amplifies, and radiates the received excitation signal. The combined outputs of the modules 300 form the desired transmitted beam pattern. The reverse process is performed in the receive mode.

FIG. 10 illustrates one of the plurality of phase shift amplifier modules 300 used to form the array 302 shown in FIG. 9. The module 300 includes a lens radiator 306 for communicating with the feed horn 304. The lens radiator 306 is coupled to a mixer circuit 308 which mixes signals traveling to and from the lens radiator with one of the phase shifted IF signals developed in the phase shift network illustrated in FIGS. 7 and 8. A transmit amplifier 310 and a receiver amplifier 312 are coupled in parallel between two circulators 314 and 316. The circulator 314 is coupled between the mixer 308, the input of the transmit amplifier 310, and the output of the output of the receive amplifier. The circulator 316 couples the output of the transmit amplifier 310 and the input of the receive amplifier to an aperture radiator 318, which transmits and receives signals external to the system. In the transmit mode, an excitation signal from the feed horn 304 is received by the lens radiator 306 and phase shifted by combination with the phased IF signal in the mixer 308. The phase shifted excitation is amplified in the transmit amplifier 310 and is radiated by the aperture radiator 318. In the receive mode, a signal received by the aperture radiator is amplified by the receive amplifier 312 and phase shifted by combination with the phased IF signal in the mixer 308. The phase shifted received signal is then transmitted via the lens radiator 306 to the feed horn 304.

The space-fed phased array system shown in FIGS. 7 through 10, which includes the phase shift network shown in FIGS. 7 and 8 according to the present Invention, is functionally equivalent to the prior art system illustrated in FIGS. 2 and 3. As previously discussed, the prior art space-fed array requires one phase shift circuit 38 for each module 30 in the array 32 for a total of (M x N) phase shifters. By contrast, the present Invention achieves a comparable result with only three phase shift circuits as shown in FIG. 7. Thus a considerable saving is achieved.

As previously discussed, the CA module 50 shown in FIG. 4 is limited to a maximum phase gradient of $\pm 90°$. If it is desired to increase the phasing per module from an initial value of $\Delta\phi_o$ to a larger value, $\Delta\phi > \Delta\phi_o$, the limitation from equations 5 and 6 must be observed in order to meet the desired $S=0$ distribution:

$$(\Delta\phi - \Delta\phi_o) < \Delta_{CRIT} = (\pi - 2\Delta\phi_o)/M \quad (25)$$

Equation 25 indicates that the achievable increment in phase gradient $\Delta\phi$ becomes even smaller as the initial gradient $\Delta\phi_o$ approaches 90° per module. Thus, phase gradients $|\Delta\phi_N| \geqq 90°$ per module are unattainable.

In order to achieve full hemispheric scanning capability, up to $\cong 180°$ phase differential between antenna elements in an array is required. One way of achieving this is to utilize two CA modules per radiating element, as discussed above with respect to FIGS. 5 and 8. Another solution to this problem is to add a fixed amount of phase shift to that developed within each CA module, as illustrated below in FIG. 11.

Figure 11:
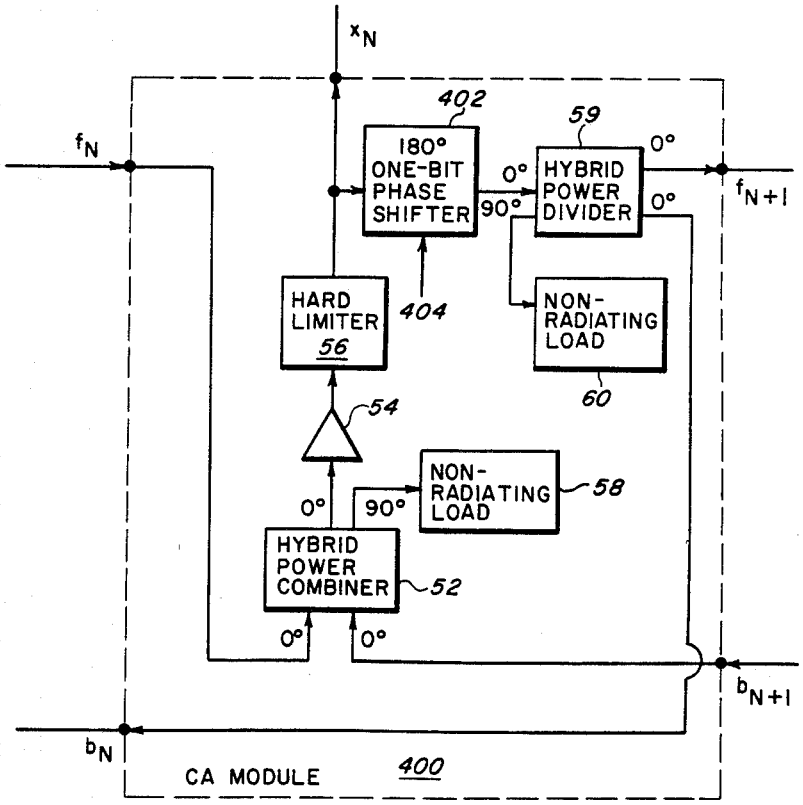
FIG. 11 is a schematic diagram illustrating an extended range coupled amplifier module according to a preferred embodiment of the present invention.

FIG. 11 illustrates an extended range coupled amplifier (CA) module 400 which can produce phase gradients over a $\pm 180°$ range. The CA module 400 is similar to the CA module 50 shown in FIG. 4 and thus elements common to the CA module 400 and the CA module 50 are correspondingly numbered in FIG. 11.

The CA module 400 differs from CA module 50 by the addition of a 180° one-bit phase shift circuit 402 between the hard limiter circuit 56 and the hybrid power divider 59. The one-bit phase shift circuit 402 is a commonly available device which exhibits two controllable states: 0° phase shift and 180° phase shift. Thus the one-bit phase shifter 402 causes the feedback signal $b_N$ and the feedforward signal $f_{N+1}$ to be shifted in phase by either 0° or 180° under control of a control signal 404. When the phase shifter 404 is in its 0° state, $f=b>0$, and the CA module 400 operates identically to the CA module 50 over a range of $\pm 90°$. However, when the phase shifter 404 is set to its 180° state, $f=b<0$, and the CA module operates over a range of $90° \leqq |\Delta\phi| < 180°$. Thus, the extended range module 400 may be used to cover the entire range of $0° \leqq \Delta\phi < 180°$ to provide full hemispheric scanning capability.

The extended range module 400 may be substituted for the module 50 in each of the phase shift networks described above thereby allowing the outputs of each module to be used with no sacrifice in scanning capability. For example, use of the module 400 in the phase shift network 70 shown in FIG. 5 would provide seven phased outputs, each having a $\pm 180°$ range. Four phased outputs could be developed with only two modules. Similarly, substituting the extended range module 400 for the CA modules 50 in the two-dimensional phase shift network 202 of FIG. 8 would result in 19 useable phased outputs instead of nine outputs. Nine phased outputs could be developed with only five extended range 400 modules.

Obviously, numerous (additional) modifications and variations of the present Invention are possible in light of the above teachings. It is therefore to be understood that within the scope of the appended claims, the invention may be practiced otherwise than as specifically described herein.

What is claimed as new and desired to be secured by Letters Patent of the United States is:

1. A phase divider system for producing a plurality of incrementally phased output signals comprising:

a plurality of phase divider modules serially coupled together to form a network, each module producing a module output signal;

said network being coupled to receive first and second boundary signals, said first and second boundary signals being coupled respectively to first and second ends of said serially coupled modules in said network, said first and second boundary signals each having an associated phase angle, the phase angle of said first boundary signal differing from the phase angle of said second boundary signal by a phase angle difference;

wherein said phase angle difference is divided by said plurality of modules in said network, said output signal of each module having a phase angle differing from the phase angles of the output signals of immediately adjacent modules in said network by a phase gradient;

whereby said phase angle difference is divided into a plurality of incrementally phased module output signals;

wherein said phase gradient is given by:

$$\Delta\phi_o = (\theta_M - \theta_o)/M$$

where:

$\Delta\phi_o$ is said phase gradient, $\theta_M$ is the phase angle of said second boundary signal, $\theta_o$ is the phase angle of said first boundary signal, and M is the total number of said plurality of modules plus one.

2. A phase divider system for producing a plurality of incrementally phased output signals comprising:

a plurality of phase divider modules serially coupled together to form a network, each module producing a module output signal;

said network being coupled to receive first and second boundary signals, said first and second boundary signals being coupled respectively to first and second ends of said serially coupled modules in said network, said first and second boundary signals each having an associated phase angle, the phase angle of said first boundary signal differing from the phase angle of said second boundary signal by a phase angle difference;

wherein said phase angle difference is divided by said plurality of modules in said network, said output signal of each module having a phase angle differing from the phase angles of the output signals of immediately adjacent modules in said network by a phase gradient;

whereby said phase angle difference is divided into a plurality of incrementally phased module output signals;

wherein the phase angle $\theta_N$ of each module output signal is given by:

$$\theta_N = N[\Delta\phi - S(2\pi/M)] + \theta_o$$

where:

N is the number of said each module, $\Delta\phi$ is the desired phase gradient to be developed by said each module, S is an integer, M is the total number of said plurality of modules plus one, and $\theta_o$ is the phase angle of said first boundary signal.

3. The phase divider system as recited in claim 2, wherein said integer S is given by:

$$S = \begin{cases} 0, (\Delta\phi - \Delta\phi_o) < \Delta_{CRIT} \\ 1, (\Delta\phi - \Delta\phi_o) > \Delta_{CRIT} \end{cases}$$

where: $\Delta_{CRIT} = (\pi - 2\Delta\phi_o)/M$ where:

$\Delta\phi$ is the desired phase gradient to be developed by said each module, $\Delta\phi_o$ is the initial phase gradient for said each module, and M is the total number of said plurality of modules plus one.

4. A phase divider system for producing a plurality of incrementally phased output signals comprising:

a plurality of phase divider modules serially coupled together to form a network, each module producing a module output signal;

said network being coupled to receive first and second boundary signals, said first and second boundary signals being coupled respectively to first and second ends of said serially coupled modules in said network, said first and second boundary signals each having an associated phase angle, the phase angle of said first boundary signal differing from the phase angle of said second boundary signal by a phase angle difference;

wherein said phase angle difference is divided by said plurality of modules in said network, said output signal of each module having a phase angle differing from the phase angles of the output signals of immediately adjacent modules in said network by a phase gradient;

whereby said phase angle difference is divided into a plurality of incrementally phased module output signals;

wherein:

each module includes a feed-forward output and a feedback output, and each module includes a feed-forward input and a feedback input;

said feedback output of each module being coupled to a feed-forward input of an immediately preceding module in said network;

said feed-forward output of each module being coupled to a feedback input of an immediately succeeding module in said network.

5. The phase divider system as recited in claim 4, wherein each module comprises:

adder means coupled to said feed-forward input and said feedback input of said module for vectoraly adding signals appearing at said inputs and for producing an adder output signal having a phase angle equal to the average phase of said signals appearing at said inputs; and limiter means coupled to receive said adder output signal for limiting the amplitude of said adder output signal to a constant amplitude and for producing said module output signal.

6. The phase divider system as recited in claim 5, wherein said adder means comprises a hybrid power combiner.

7. The phase divider system as recited in claim 5, wherein each module further comprises:

power divider means coupled to receive said module output signal for dividing said module output signal into first and second feed signals, said first feed signal being coupled to said feed-forward output of said module, said second feed signal being coupled to said feedback output of said module.

8. The phase divider system as recited in claim 5, wherein each module further comprises:

one-bit phase shift circuit means coupled to receive said module output signal for shifting the phase of said module output signal by 180°; and power divider means coupled to receive the output of said one-bit phase shift circuit means for dividing said output of said means into first and second feed signals, said first feed signal being coupled to said feed-forward output of said module, said second feed signal being coupled to said feedback output of said module.

9. A phase divider system for producing a plurality of incrementally phased output signals comprising:

a plurality of phase divider modules serially coupled together to form a network, each module producing a module output signal; and phase shift circuit means coupled to receive a first boundary signal having an associated phase angle for shifting the phase of said first boundary signal to produce a second boundary signal, the phase angle of said first boundary signal differing from the phase angle of said second boundary signal by a phase angle difference, said network being coupled to receive said first and second boundary signals, said first and second boundary signals being coupled respectively to first and second ends of said serially coupled modules in said network;

wherein said phase angle difference is divided by said plurality of modules in said network, said output signal of each module having a phase angle differing from the phase angles of the output signals of immediately adjacent modules by a phase gradient;

whereby said phase angle difference is divided into a plurality of incrementally phased output signals wherein said phase gradient is given by:

$$\Delta\phi_o = (\theta_M - \theta_o)/M$$

where:

$\Delta\phi_o$ is said phase gradient, $\theta_M$ is the phase angle of said second boundary signal, $\theta_o$ is the phase angle of said first boundary signal, and M is the total number of said plurality of modules plus one.

10. A phase divider system for producing a plurality of incrementally phased output signals comprising:

a plurality of phase divider modules serially coupled together to form a network, each module producing a module output signal; and phase shift circuit means coupled to receive a first boundary signal having an associated phase angle for shifting the phase of said first boundary signal to produce a second boundary signal, the phase angle of said first boundary signal differing from the phase angle of said second boundary signal by a phase angle difference, said network being coupled to receive said first and second boundary signals, said first and second boundary signals being coupled respectively to first and second ends of said serially coupled modules in said network;

wherein said phase angle difference is divided by said plurality of modules in said network, said output signal of each module having a phase angle differing from the phase angles of the output signals of immediately adjacent modules by a phase gradient;

whereby said phase angle difference is divided into a plurality of incrementally phased output signals.

where the phase angle $\theta_N$ of each module output signal is given by:

$$\theta_N = N[\Delta\phi - S(2\pi/M)] + \theta_o$$

where:

N is the number of said each module, $\Delta\phi$ is the desired phase gradient to be developed by said each module, S is an integer, M is the total number of said plurality of modules plus one, and $\theta_o$ is the phase angle of said first boundary signal.

11. The phase divider system as recited in claim 10, wherein said integer S is given by:

$$S = \begin{cases} 0, & (\Delta\phi - \Delta\phi_o) < \Delta_{CRIT} \\ 1, & (\Delta\phi - \Delta\phi_o) > \Delta_{CRIT} \end{cases}$$

where: $\Delta_{CRIT} = (\pi - 2\Delta\phi_o)/M$ where:

$\Delta\phi$ is the desired phase gradient to be developed by said each module, $\Delta\phi_o$ is the initial phase gradient for said each module, and M is the total number of said plurality of modules plus one.

12. A phase divider system for producing a plurality of incrementally phased output signals comprising:

a plurality of phase divider modules serially coupled together to form a network, each module producing a module output signal; and phase shift circuit means coupled to receive a first boundary signal having an associated phase angle for shifting the phase of said first boundary signal to produce a second boundary signal, the phase angle of said first boundary signal differing from the phase angle of said second boundary signal by a phase angle difference, said network being coupled to receive said first and second boundary signals, said first and second boundary signals being coupled respectively to first and second ends of said serially coupled modules in said network;

wherein said phase angle difference is divided by said plurality of modules in said network, said output signal of each module having a phase angle differing from the phase angles of the output signals of immediately adjacent modules by a phase gradient;

whereby said phase angle difference is divided into a plurality of incrementally phased output signals, wherein:

each module includes a feed-forward output and a feedback output; and each module includes a feed-forward input and a feedback input;

said feedback output of each module being coupled to a feed-forward input of an immediately preceeding module in said network;

said feed-forward output of each module being coupled to a feedback input of an immediately succeeding module in said network.

13. The phase divider system as recited in claim 12, wherein each module comprises:

adder means coupled to said feed-forward input and said feedback input of said module for vectoraly adding signals appearing at said inputs and for producing an adder output signal having a phase angle equal to the average phase of said signals appearing at said inputs; and limiter means coupled to receive said adder output signal for limiting the amplitude of said adder output signal to a constant amplitude and for producing said module output signal.

14. The phase divider system as recited in claim 13, wherein said adder means comprises a hybrid power combiner.

15. The phase divider system as recited in claim 13, wherein each module further comprises:

power divider means coupled to receive said module output signal for dividing said module output signal into first and second feed signals, said first feed signal being coupled to said feed-forward output of said module, said second feed signal being coupled to said feedback output of said module.

16. The phase divider system as recited in claim 13, wherein each module further comprises:

one-bit phase shift circuit means coupled to receive said module output signal for shifting the phase of said module output signal by 180°; and power divider means coupled to receive the output of said one-bit phase shift circuit means for dividing said output of said means into first and second feed signals, said first feed signal being coupled to said feed-forward output of said module, said second feed signal being coupled to said feedback output of said module.

17. A phase divider system for producing a plurality of incrementally phased output signals comprising:

a plurality of phase divider modules coupled together to form a network, each module producing a module output signal;

said network being coupled to receive at least two boundary signals having differing phase angles;

wherein the phase angle difference between said at least two boundary signals is divided by said phase divider modules in the said network, said output signal of each of said plurality of modules having a phase angle differing from the phase angles of the output signals of immediately adjacent modules in said network by a phase gradient;

whereby said phase angle difference between said at least two boundary signals is divided into a plurality of incrementally phased module output signals, wherein:

said plurality of modules are coupled serially together to form said network, said network being coupled to receive first and second boundary signals, said first and second boundary signals being coupled respectively to first and second ends of said serially coupled modules in said network wherein said phase gradient is given by:

$$\Delta\phi_o=(\theta_M-\theta_o)/M$$

where:

$\Delta\phi_o$ is said phase gradient, $\theta_M$ is the phase angle of said second boundary signal, and $\theta_o$ is the phase angle of said first boundary signal, and M is the total number of said plurality of modules plus one.

18. A phase divider system for producing a plurality of incrementally phased output signals comprising:

a plurality of phase divider modules coupled together to form a network, each module producing a module output signal;

said network being coupled to receive at least two boundary signals having differing phase angles;

wherein the phase angle difference between said at least two boundary signals is divided by said phase divider modules in the said network, said output signal of each of said plurality of modules having a phase angle differing from the phase angles of the output signals of immediately adjacent modules in said network by a phase gradient;

whereby said phase angle difference between said at least two boundary signals is divided into a plurality of incrementally phased module output signals, wherein the phase angle $\theta_N$ of each module output signal is given by:

$$\theta_N=N[\Delta\phi-S(2\pi/M)]+\theta_o$$

where:

N is the number of said each module, $\Delta\phi$ is the desired phase gradient to be developed by said each module, S is an integer, M is the total number of said plurality of modules plus one, and $O_o$ is the phase angle of said first boundary signal.

19. The phase divider system as recited in claim 18, wherein said integer S is given by:

$$S=\begin{cases}0, (\Delta\phi-\Delta\phi_o)<\Delta_{CRIT}\\ 1, (\Delta\phi-\Delta\phi_o)>\Delta_{CRIT}\end{cases}$$

where: $\Delta_{CRIT}=(\pi-2\Delta\phi_o)/M$ where:

$\Delta\phi$ is the desired phase gradient to be developed by said each module, $\Delta\phi_o$ is the initial phase gradient for said each module, and M is the total number of said plurality of modules plus one.

20. A phase divider system for producing a plurality of incrementally phased output signals comprising:

a plurality of phase divider modules coupled together to form a network, each module producing a module output signal;

said network being coupled to receive at least two boundary signals having differing phase angles;

wherein the phase angle difference between said at least two boundary signals is divided by said phase divider modules in the said network, said output signal of each of said plurality of modules having a phase angle differing from the phase angles of the output signals of immediately adjacent modules in said network by a phase gradient;

whereby said phase angle difference between said at least two boundary signals is divided into a plurality of incrementally phased module output signals wherein:

each module includes a feed-forward output and a feedback output; and each module includes a feed-forward input and a feedback input;

said feedback output of each module being coupled to a feed-forward input of an immediately preceeding module in said network;

said feed-forward output of each module being coupled to a feedback input of an immediately succeeding module in said network.

21. The phase divider system as recited in claim 20, wherein each module comprises:

adder means coupled to said feed-forward input and said feedback input of said module for vectoraly adding signals appearing at said inputs and for producing an adder output signal having a phase angle equal to the average phase of said signals appearing at said inputs; and limiter means coupled to receive said adder output signal for limiting the amplitude of said adder output signal to a constant amplitude and for producing said module output signal.

22. The phase divider system as recited in claim 21, wherein said adder means comprises a hybrid power combiner.

23. The phase divider system as recited in claim 21, wherein each module further comprises:

power divider means coupled to receive said module output signal for dividing said module output signal into first and second feed signals, said first feed signal being coupled to said feed-forward output of said module, said second feed signal being coupled to said feedback output of said module.

24. The phase divider system as recited in claim 21, wherein each module further comprises:

one-bit phase shift circuit means coupled to receive said module output signal for shifting the phase of said module output signal by 180°; and power divider means coupled to receive the output of said one-bit phase shift circuit means for dividing said output of said means into first and second feed signals, said first feed signal being coupled to said feed-forward output of said module, said second feed signal being coupled to said feedback output of said module.

* * * * *